US006390516B1

(12) United States Patent
Kobayashi

(10) Patent No.: US 6,390,516 B1
(45) Date of Patent: May 21, 2002

(54) DOOR LOCK UNIT OF VEHICULAR DOOR CLOSURE SYSTEM

(75) Inventor: Fumio Kobayashi, Yokohama (JP)

(73) Assignee: Ohi Seisakusho Co. Ltd., Kanagawa-ken (JP)

( * ) Notice: Subject to any disclaimer, the term of this patent is extended or adjusted under 35 U.S.C. 154(b) by 0 days.

(21) Appl. No.: 09/388,973

(22) Filed: Sep. 2, 1999

(30) Foreign Application Priority Data

Sep. 3, 1998 (JP) ..... 10-249912
Sep. 3, 1998 (JP) ..... 10-249926

(51) Int. Cl.[7] ..... E05C 3/06
(52) U.S. Cl. ..... 292/201; 292/216; 49/280
(58) Field of Search ..... 292/216, 201, 292/DIG. 23; 49/280

(56) References Cited

U.S. PATENT DOCUMENTS 5,288,115 A * 2/1994 Inoue ..... 292/201
5,618,068 A * 4/1997 Mitsui ..... 292/201
5,713,613 A * 2/1998 Honma ..... 292/201
5,732,988 A * 3/1998 Mizuki ..... 292/201
6,053,542 A * 4/2000 Ostrowski ..... 292/201

* cited by examiner

*Primary Examiner*—Gary Estremsky
(74) *Attorney, Agent, or Firm*—Kilpatrick Stockton LLP

(57) ABSTRACT

In a door lock unit of a vehicular door closure system, a closing lever and the outer periphery of a latching plate are disposed on substantially the same plane, the closing lever being provided in the vertical direction passes the upper part of the latching plate and is then bent downward, and corresponding parts of the closing lever and the wire being in the vertical direction, so that the amount of space required by the door lock unit within a door is reduced.

10 Claims, 18 Drawing Sheets

DOOR LOCK UNIT OF VEHICULAR DOOR CLOSURE SYSTEM

BACKGROUND OF THE INVENTION

1. Field of the Invention

The present invention relates to a door lock unit of a vehicular door closure system, and particularly, to a door lock unit of a power-assisted door closure system for vehicles.

2. Description of Related Art

In some vehicles, there are hinged or sliding side doors and/or rear doors that are provided with a door closure system, whereby by just closing the door to a half-closed condition, drive power of an incorporated motor brings the door to a fully closed condition. (For similar technology, refer to Nissan Motor Corporation's new vehicle manual W30-1, pages D-31 to D-35.)

This type of door closure system is constituted with a drive unit and a door lock unit both disposed within a vehicular door. The drive unit and the door lock unit are linked with each other through an actuation wire, and drive power of an electric motor that is provided in the drive unit is transmitted to the door lock unit via the wire.

The door lock unit includes a latching plate that engages with a striker that is provided on the vehicle side, a closing lever which engages with the latching plate and causes it to rotate in an engagement direction, and an actuation wire that is linked to the closing lever and which transmits drive power. From the standpoint of ease of assembly, the latching plate, closing lever, and wire are generally assembled in a mutually overlapping manner.

The latching plate of the door lock unit can rotate reciprocally about a shaft, from a released position, through a half-latched position, up to a fully latched position. When the latching plate reaches the half-latched position, a half-latched switch detects this condition, the wire is pulled by the drive unit so as to move the closing lever that is linked to the wire, so that part of the closing lever engages with the latching part of the latching plate, the latching plate being forcibly rotated from the half-latched position up to the fully latched position. By doing this, the latching plate, which was in the half-latched position, is brought to the fully latched position, at which it engages fully with the striker.

When the fully latched position is reached, the fully latched switch detects this condition, the motor being rotated in the reverse direction so as to push the wire. When this is done, the engagement between the closing lever and the latching plate is released, the closing lever returning to a position that is further to the outside of the rotational path of the engaging part from the fully latched position up to the half-latched position. That is, the closing lever is not allowed to be positioned at a point between the fully latched position and the half-latched position. The reason for this is that, if the latching plate that rotated in the reverse direction should for some reason come into contact with the closing lever and stop at an intermediate position, a false locked condition would occur, which neither the fully latched switch nor the half-latched switch would be able to detect. For this reason, to prevent this situation, the latching plate is not allowed to engage with the closing lever until it reaches at least the half-latched position. By doing this, even if something should cause the latching plate to rotate in the reverse direction, the latching plate will return as far as the half-latched position. Once it returns to the half-latched position, the half-latched switch will detect it once again, enabling the latching plate to be swung up to the fully latched position once again, so that the intermediate condition does not occur.

In the above-noted technology, however, because the latching plate, the closing lever, and the wire are assembled so as to be mutually overlapping, there is an increase in the thickness of the door in the longitudinal direction thereof, this causing a critical reduction in installation space for a rollup/rolldown window that is provided within the door.

In the technology of the past, because the construction was such that the closing lever was caused to move in a straight line along the direction of the pulling of the wire, and such that, after the reaching the fully latched position, the closing plate was returned to a position that is outside the limitation of swinging motion of the engaging part up until the latching plate half-latched position, the stroke of the wire was large. Therefore, there was an increase in the amount of slack, between the time the drive unit motor starts rotating, until the latching plate actually starts swinging, resulting in a long time required to reach the fully latched position from the half-latched position.

The fact that the wire stroke was large makes the drive unit for the purpose of pulling the wire large, this not only leading to an increase in weight, but also a worsening of the efficient use of space within the door.

Accordingly, the invention was in consideration of the related art as noted above, and has as an object the provision of a door lock unit of a vehicular door closure system, which is capable of providing a reduction in the thickness of the door in the longitudinal direction.

It is another object of the invention to provide a door lock unit of a vehicular door closure system, which is capable of providing a shortening of the drive wire stroke.

SUMMARY OF THE INVENTION

A first aspect of the invention is a door lock unit of a vehicular door closure system, this door lock unit having a latching plate, which is free to reciprocally swing about an axis from a released position, through a half-latched position, to a fully latched position, a closing lever, which is provided so as to extend in the up/down direction, and which, when it rises to an engaging part formed on an edge of the latching plate, engages therewith and causes the latching plate to swing toward the fully latched position, and a wire, which is linked to the lower end of the closing lever, and which transmits driving force for the purpose of raising the closing lever, the closing lever and the outer peripheral part of the latching plate being disposed on substantially the same plane, and the wire passing the upper part of the latching plate, after which it is bent downward and linked to the lower end of the closing lever.

According to the first aspect of the invention, because the closing lever and the outer periphery of the latching plate are disposed on substantially the same plane, it is possible to reduce the, thickness of the door lock unit. There is therefore no problem with achieving sufficient space within the door, thereby facilitating the layout of a rollup/rolldown glass within the door. Additionally, because the closing lever is provided in the up/down direction and the wire passes the upper part of the latching plate and is then bent downward, corresponding parts of the closing lever and the wire are each in the vertical direction, thereby enabling a reduction in the width size (size in the direction perpendicular to the width) of the door lock unit. It is therefore possible to reduce the thickness of the door itself, thereby enabling an expansion of the space within the vehicle and an improvement in appearance. Additionally, because the wire is linked to the lower end of the closing lever, the driving force of the wire makes a U-turn via the closing lever, and then is transmitted to the latching plate, the result being that it is possible to reduce the vertical size of the door lock unit. Therefore, layout of other components in the vertical space of the door lock unit is facilitated.

The second aspect of the invention is a door lock unit of a vehicular door closure system as in the first aspect, this door lock unit further having a cover that covers the latching plate and the closing lever, the lower edge of the cover being formed with a step towards the closing lever, the lower end of the closing lever being mounted to the lower end of the cover so as to be freely movable upward and downward.

According to the second aspect of the invention, because the rigidity of the cover is raised by forming a step in the lower edge thereof, and because the lower end of the closing lever is linked to the lower end thereof, there is no loss of mounting rigidity of the closing lever, even if the thickness of the door lock unit is reduced.

A third aspect of the invention is a door lock unit according to the first aspect noted above, wherein an engagement groove, which accepts the striker, and an engagement part that inputs rotational force are formed on the latching plate, and wherein on the upper end of the closing lever a protrusion, which engages the latching plate engaging part that is disposed at the half-latched position, and a pin, which is in the direction perpendicular to the surface of the latching plate are formed, a guide hole being formed on the body onto which the latching plate and closing lever are mounted, into which the pin on the other end of the closing lever is positioned. On the latching plate end of the guide hole, an inclined edge is formed, at a prescribed angle with respect to direction that the wire pulls the closing lever, and a biasing mechanism is provided on the body, which biases the pin on the other end of the closing lever toward to this inclined edge. When the closing lever is pulled by the wire, the pin of the closing lever moves toward the latching plate at a prescribed angle, along the inclined edge of the guide hole, the protrusion of the closing lever engaging with the engaging part of the latching plate and causing the latching plate to swing toward the fully latched position, and when the closing lever is pushed by the wire, the protrusion of the closing lever returns to outside the limit of swinging of the engaging part from the fully latched position to the half-latched position.

According to the third aspect of the invention, because the pin of the closing lever moves toward the latching plate at a prescribed angle, along the inclined edge of the guide hole, compared to the case in which the closing lever is moved in a straight line along the pulling direction of the wire, the movement is along what could be called a shortcut, thereby enabling a shortening of the wire stroke. Therefore, in addition to a shortening of the amount of slack from the time the wire is pulled until the point at which the latching plate actually swings, making it possible to reduce the size of the drive unit that drives the wire, it is possible to reduce the weight of the vehicle body, and to improve the efficiency of use of space within the door.

In a fourth aspect of the invention, a pull lever, which has an elongated arc-shaped hole having as its center of curvature the axis of the latching plate and disposed substantially on the same plane as the outer periphery of the latching plate, is provided on the upper part of the closing lever, the pin on the upper end of the closing lever being made to engage the elongated hole, and a spring being provided on the upper end of the pull lever so as to bias the elongated hole part in an approaching direction to the latching plate.

According to the fourth aspect of the invention, because the above-noted biasing mechanism is provided by mechanism of the spring and the pull lever, this pushing the pin within the elongated hole toward the inclined edge, the closing lever pin moves reliably along the inclined edge of the guide hole. Because the elongated hole is arc-shaped, with its center at the axis of the latching plate, the action of the closing lever protrusion is to push the latching plate engaging part in the shape of an arc, thereby enabling the reliable swinging of the latching plate up to the fully latched position.

In a fifth aspect of the invention, in addition to making the width of the guide hole that is formed on the body a size that allows the pin of the closing lever to move horizontally, the upper end of the pull lever is bent toward the latching plate, and an outside lever is mounted to the bottom of the pull lever so as to be able to swing about the axis, a pull link being provided so as to join the end of the outside lever that rises when an opening operation is done with the upper end of the pull lever, and the outside lever and pull lever being each disposed substantially on one and the same surface on the periphery of the latching plate.

According to the fifth aspect of the invention, because the operation of opening the outside lever causes the associated operating force to be transmitted from the pull link to the pull lever, thereby causing the elongated hole part of the pull lever to swing in the direction away from the latching plate, the upper end of the closing lever that is engaged with the elongated hole also moves away from the latching plate, thereby enabling reliable swinging of the latching plate from the half-latched position to the released position, without interference with the closing lever.

A sixth aspect of the invention is a door lock unit of a vehicular door closure system, this door lock unit having a latching plate, which is free to reciprocally swing about an axis from a released position, through a half-latched position, to a fully latched position, this latching plate having an engaging groove, which accepts a striker that is provided on the vehicle side, and an engaging part at which rotational force is input, a closing lever being provided at a position adjacent to the latching plate, the distal end of which in the wire path being linked to a wire and moving the wire, and the other end of which having formed therein a protrusion which engages with the engaging part of the latching plate in the half-latched position and a pin, which protrudes in a direction that is perpendicular with respect to the latching plate surface. On the body to which the latching plate and closing lever are mounted is formed a guide hole, into which is positioned the pin at the other end of the closing lever, and an inclined edge which is inclined towards the latching plate by a prescribed angle with respect to the direction in which the wire pulls the closing lever, and a biasing mechanism is provided on the body, which biases the pin on the other end of the closing lever toward the inclined edge. When the closing lever is pulled by the wire, the pin of the closing lever moves toward the latching plate at a prescribed angle, along the inclined edge of the guide hole, the protrusion of the closing lever engaging with the engaging part of the latching plate and causing the latching plate to swing toward the fully latched position, and when the closing lever is pushed by the wire, the protrusion of the closing lever returns to outside the limit of swinging of the engaging part from the fully latched position to the half-latched position.

According to the sixth aspect of the invention, because the pin of the closing lever moves toward the latching plate at a prescribed angle, along the inclined edge of the guide hole when the wire pulls the closing lever, compared to the case in which the closing lever is moved in a straight line along the pulling direction of the wire, the movement is along what could be called a shortcut, thereby enabling a shortening of the wire stroke. Therefore, in addition to a shortening of the amount of slack from the time the wire is pulled until the point at which the latching plate actually swings, it is possible to reduce the size of the drive unit that drives the wire, it is possible to make a reduction in the weight of the vehicle body, and to improve the efficiency of use of space within the door.

In a seventh aspect of the invention, a pull lever having an elongated arc-shaped hole having as its center of curvature the axis of the latching plate, is provided on the upper part of the closing lever, the pin on the upper end of the closing lever being made to engage the elongated hole, and a spring being provided on the upper end of the pull lever so as to bias the elongated hole part in an approaching direction to the latching plate.

According to the seventh aspect of the invention, because the above-noted biasing mechanism is provided by mechanism of the spring and the pull lever, this pushing the pin within the elongated hole toward the inclined edge, the closing lever pin moves reliably along the inclined edge of the guide hole. Because the elongated hole is arc-shaped, with its center at the axis of the latching plate, the action of the closing lever protrusion is to push the latching plate engaging part in the shape of an arc, thereby enabling the reliable swinging of the latching plate up to the fully latched position.

In an eighth aspect of the invention, in addition to making the width of the guide hole that is formed on the body a size that allows the pin of the closing lever to move horizontally, the upper end of the pull lever is bent toward the latching plate, and an outside lever is mounted to the bottom of the pull lever so as to be able to swing about the axis, a pull link being provided so as to join the end of the outside lever that rises when an opening operation is done with the upper end of the pull lever.

According to the eighth aspect of the invention, because the operation of opening the outside lever causes the associated operating force to be transmitted from the pull link to the pull lever, thereby causing the elongated hole part of the pull lever to swing in the direction away from the latching plate, the upper end of the closing lever that is engaged with the elongated hole also moves away from the latching plate, thereby enabling reliable swinging of the latching plate from the half-latched position to the released position, without interference with the closing lever.

In a ninth aspect of the invention, a pawl is provided at a position adjacent to the latching plate, this pawl inhibiting the return swing of the latching plate by having one end thereof engage with the latching plate at the half-latched position and at the fully latched position, the other end of the pawl being linked to by a link to the end of the outside lever than is lowered when an outside lever opening operation is performed.

According to the ninth aspect of the invention, because the operating force when the outside lever is opened is transmitted to the other end of the pawl via the link, it is possible to swing the pawl in the direction of disengagement from the latching plate. Even when the pawl is provided, it is therefore possible to cause the latching plate to swing reliably to the released position.

According to a tenth aspect of the invention, a door lock unit of a vehicular door closure system comprises a latch plate that swings about a first axis and engages with a striker, a closing lever, which swings about a second axis, which is lower than the first axis, and which engages with the latching plate, and a mechanism that controls the distance between the first and the second axes, wherein the distance controlling mechanism includes an operating wire, this operating wire being linked to the second axis and moving the second shaft up and down.

The tenth aspect of the invention allows for a reduced door thickness.

According to an eleventh aspect of the invention, the closing lever can swing about a third axis, which is higher than the second axis, and the third axis can move horizontally with respect to the first axis.

The eleventh aspect of the invention allows for the wire to have a shorter way.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
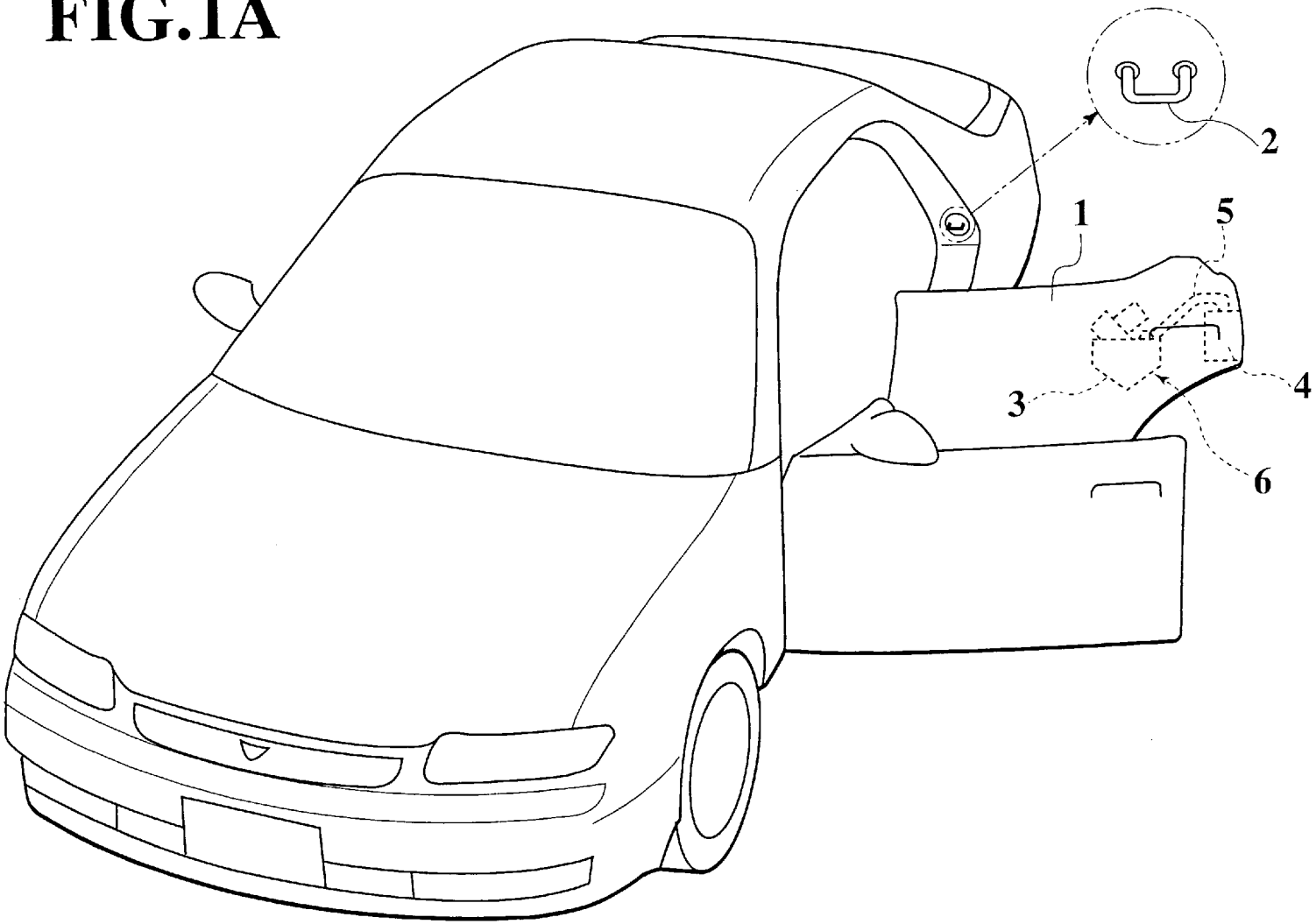
FIG. 1A is a perspective view that shows a vehicle with a hinged side door, to which a door closure system according to an embodiment of the invention is installed.

There will be detailed below the preferred embodiments of the present invention with reference to the accompanying drawings. Like members are designated by like reference characters.

Figure 1B:
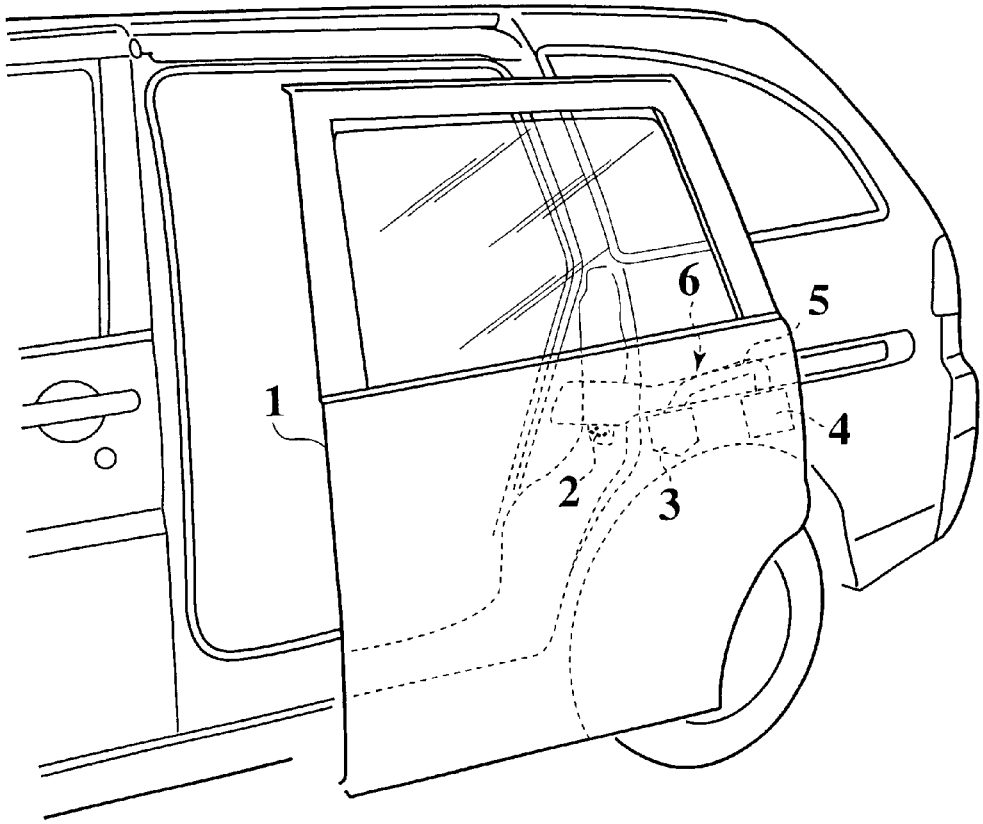
FIG. 1B is a perspective view that shows a vehicle with a sliding side door, to which the door closure system is installed.

FIG. 1A shows a hinged door 1, and FIG. 1B shows a sliding door. The sliding door is opened and closed to the front and rear, and moves toward the vehicle immediately before closing, at which point it engages with a striker 2 that is provided on the vehicle.

Figure 2:
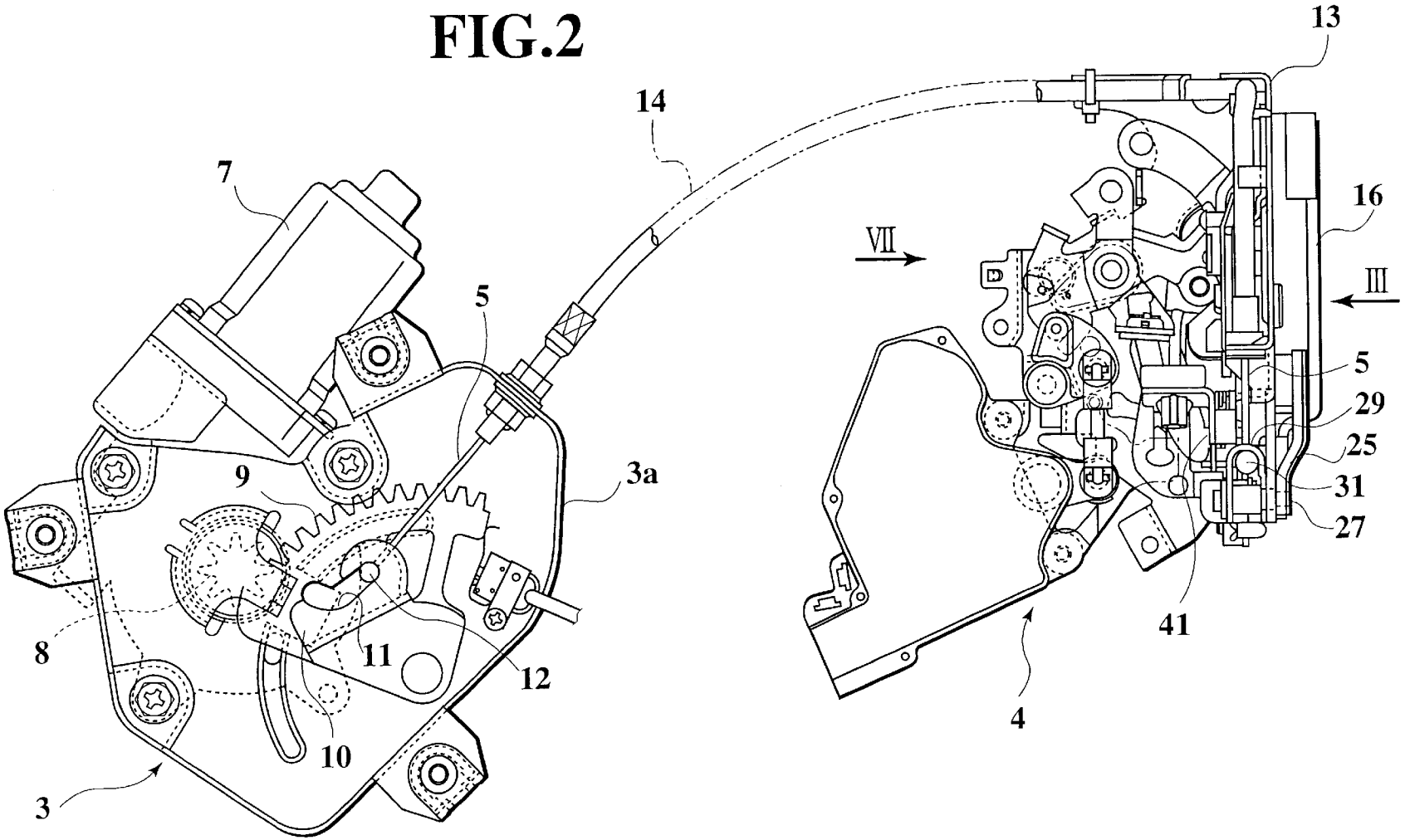
FIG. 2 is a side view that shows a drive unit and a door lock unit of the door closure system.
Figure 3:
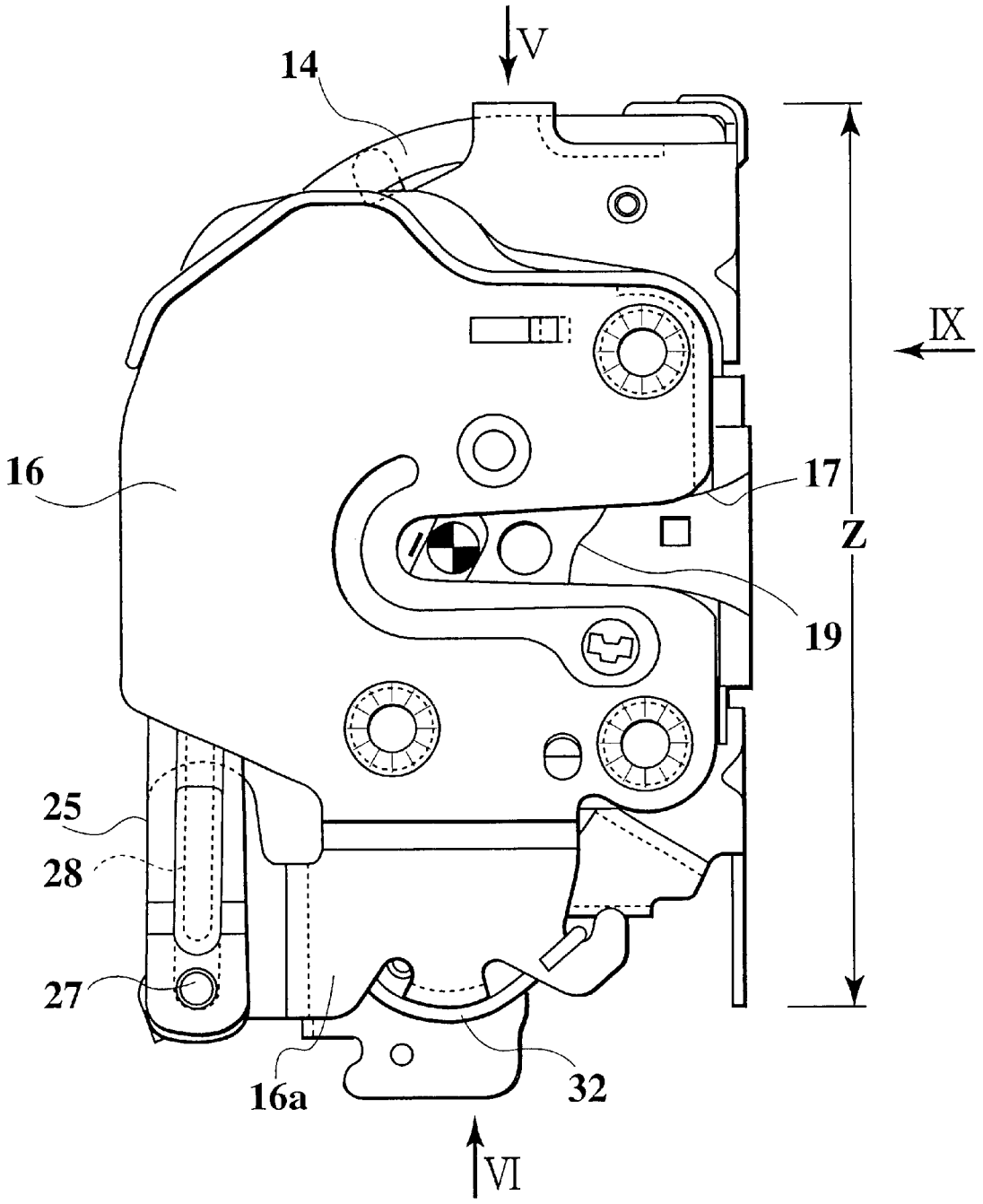
FIG. 3 is a side view as seen in the direction of arrow III of FIG. 2.
Figure 4:
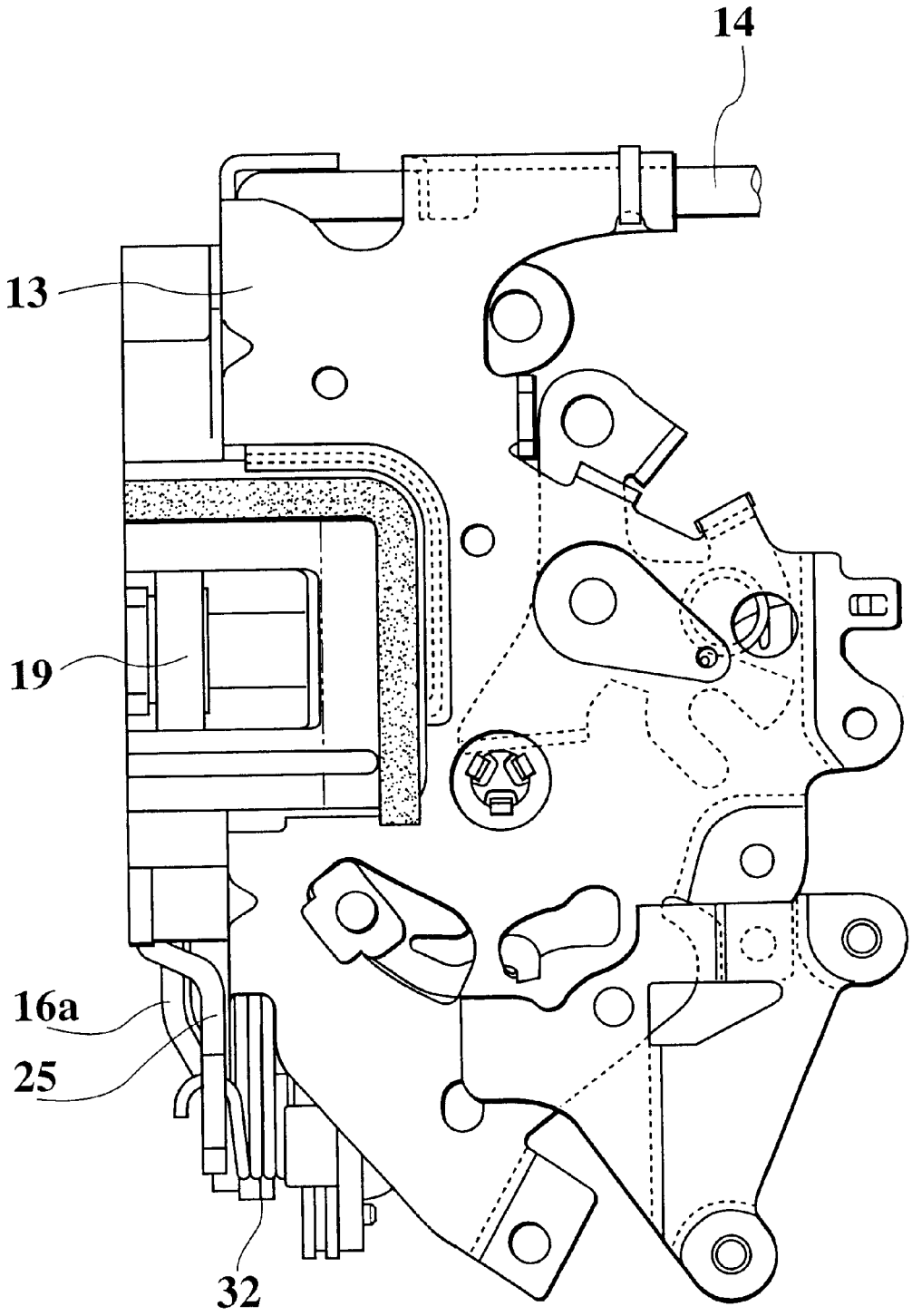
FIG. 4 is a side view as seen in the direction of arrow IV of FIG. 5.

As shown in FIG. 2, a drive unit 3 and a door lock unit 4 are linked by an actuation wire 5 to foil a door closure system 6 inside the vehicle. The drive unit 3 causes a pinion gear 8, which is rotated by a motor 7, to engage with a rack gear 9, thereby causing the rack gear 9 to rotate at a reduced speed. A bracket 10 is fixed to this rack gear 9 at a prescribed distance, a T-shaped head pin 12 of the wire 5 engaging a cutout 11 that is formed at a position that corresponds to the bracket 10 and the rack gear 9. One end of the wire 5, which runs from the drive unit 3 to the door lock unit 4, is covered by an outer tube 14 that is fixed to a base 3*a* of the drive unit 3.

The construction of the door lock unit 4 is as follows. FIG. 3 through FIG. 9 show outer views of the door lock unit 4, FIG. 10 through FIG. 13 shows the internal construction of the door lock unit 4, and FIG. 14 through FIG. 18 shows the operation of the door lock unit 4.

The overall construction of the door lock unit 4 is basically one in which a base 13 is machined from a metal panel and fixed to a resin body 15 (FIG. 11), with various components mounted to the body 15, after which it is covered by a cover 16. The wire 5, which is covered by the outer tube 14, is guided to the top of the door lock unit 4, and is then bent along the body 15 toward the outside of the vehicle, after which it is bent toward the bottom of the door lock unit 4. Of this wire 5, the part that is bent to outside the vehicle and the part that is bent downward are disposed above the latching plate 19, to be described below, in substantially one and the same plane. Guides 17 and 18 are formed in the cover 16 and the body 15 for the purpose of accepting the striker 2 of the vehicle (shown in FIG. 3 and FIG. 11).

Figure 10:
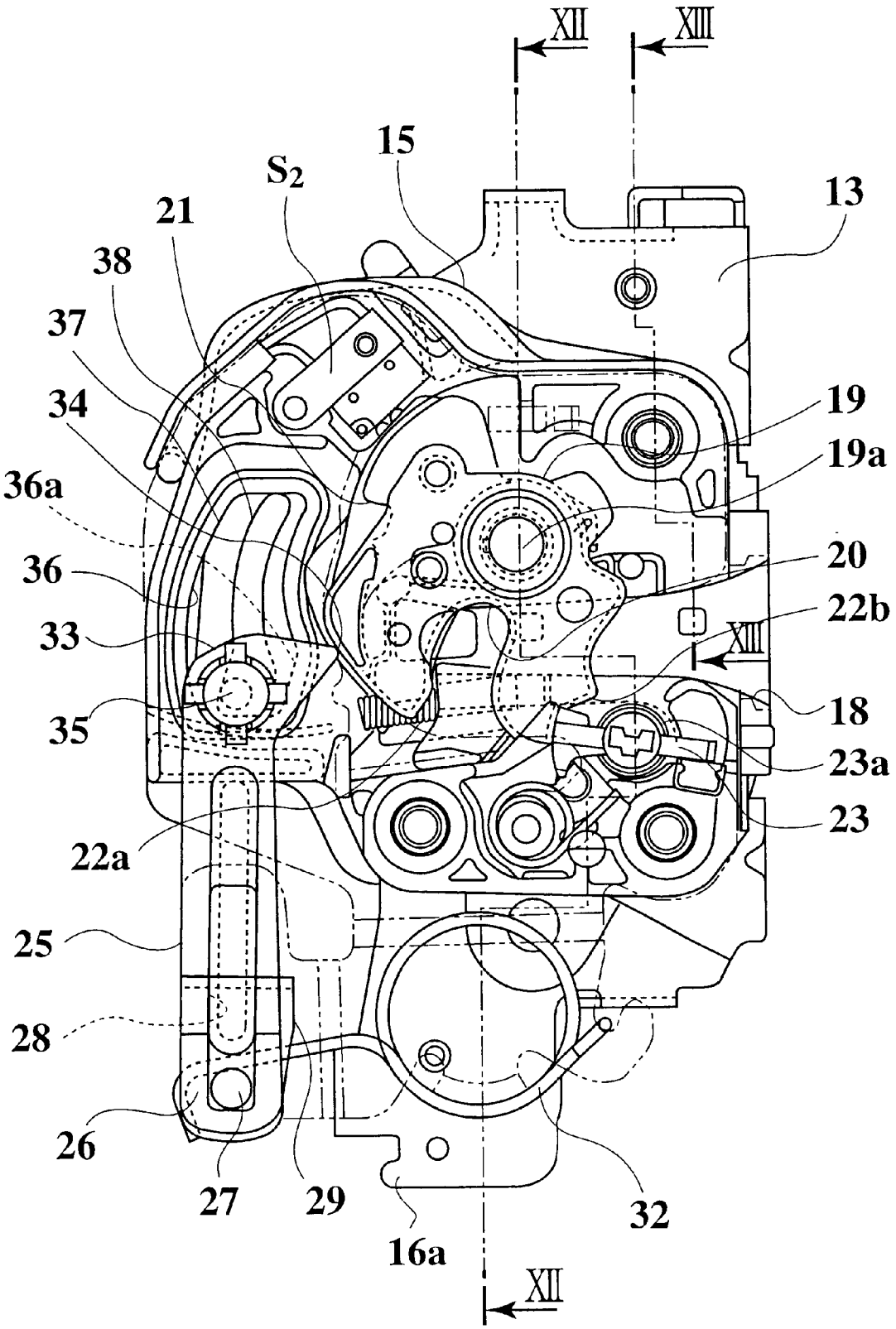
FIG. 10 is a side view that shows a condition in which a cover in FIG. 3 has been removed.
Figure 11:
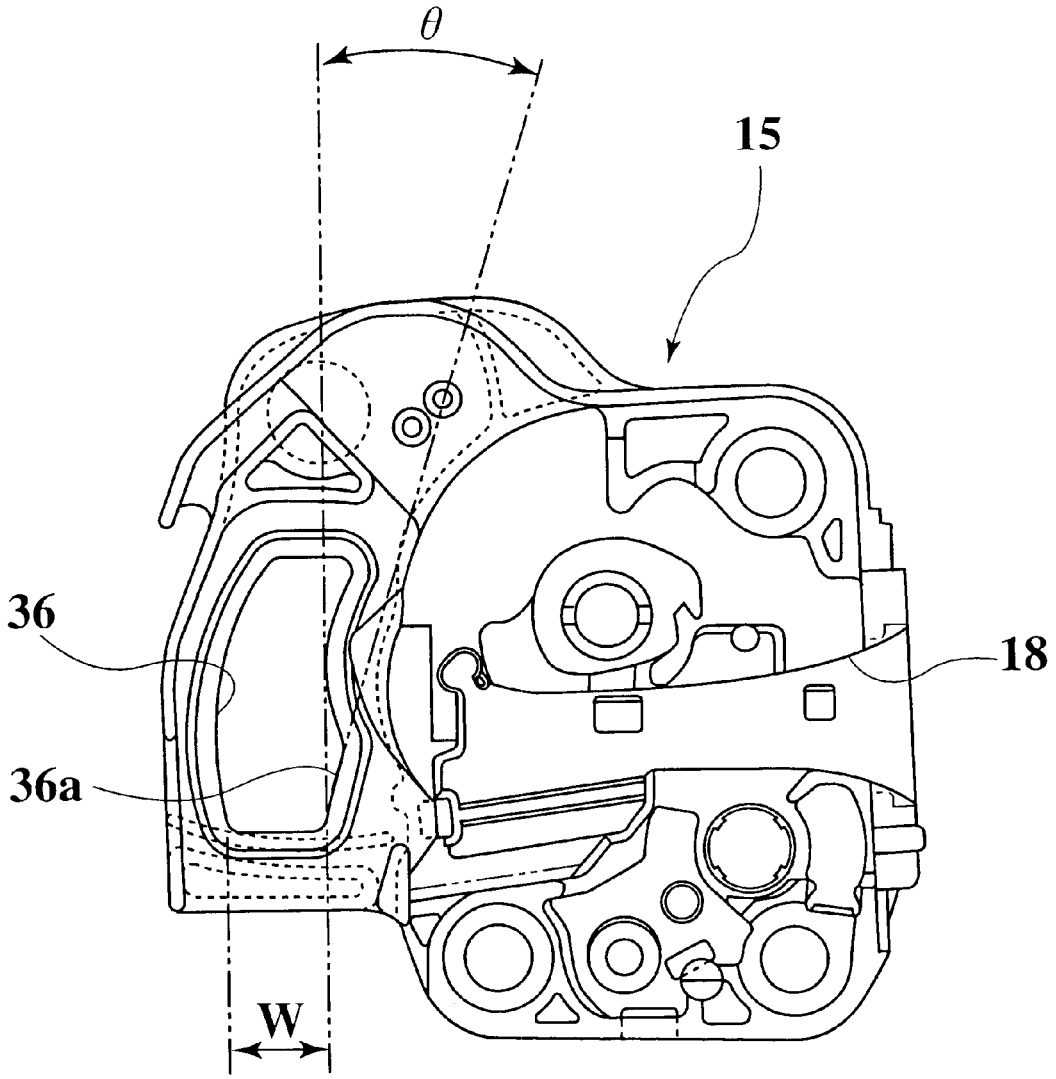
FIG. 11 is a side view of a body.
Figure 12:
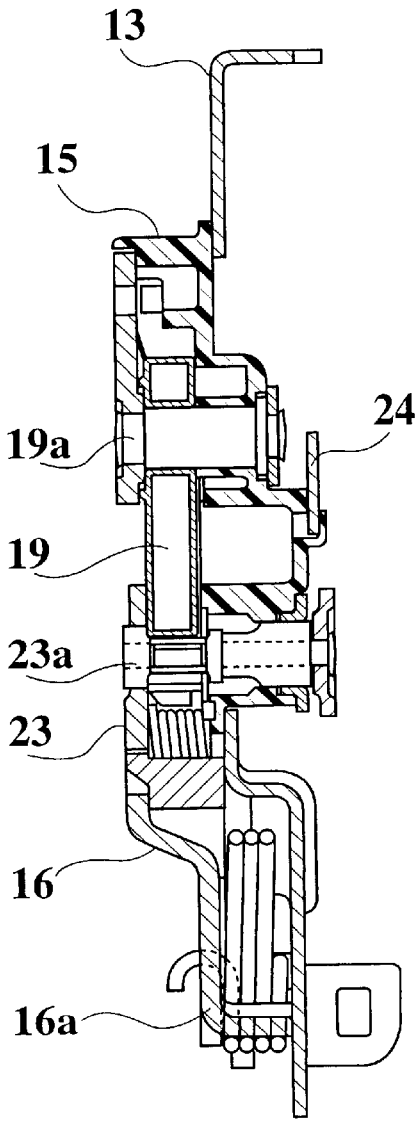
FIG. 12 is a cross-sectional view along line XII—XII of FIG. 10, showing a condition in which the cover is in place.
Figure 13:
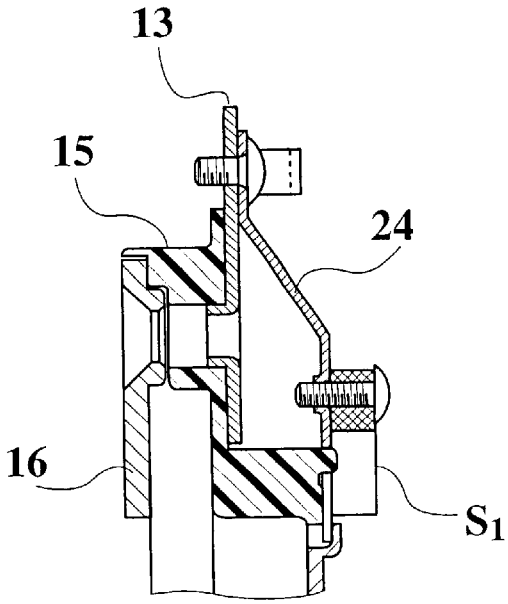
FIG. 13 is a cross-sectional view along line XIII—XIII of FIG. 10, showing the condition in which the cover is in place.
Figure 14:
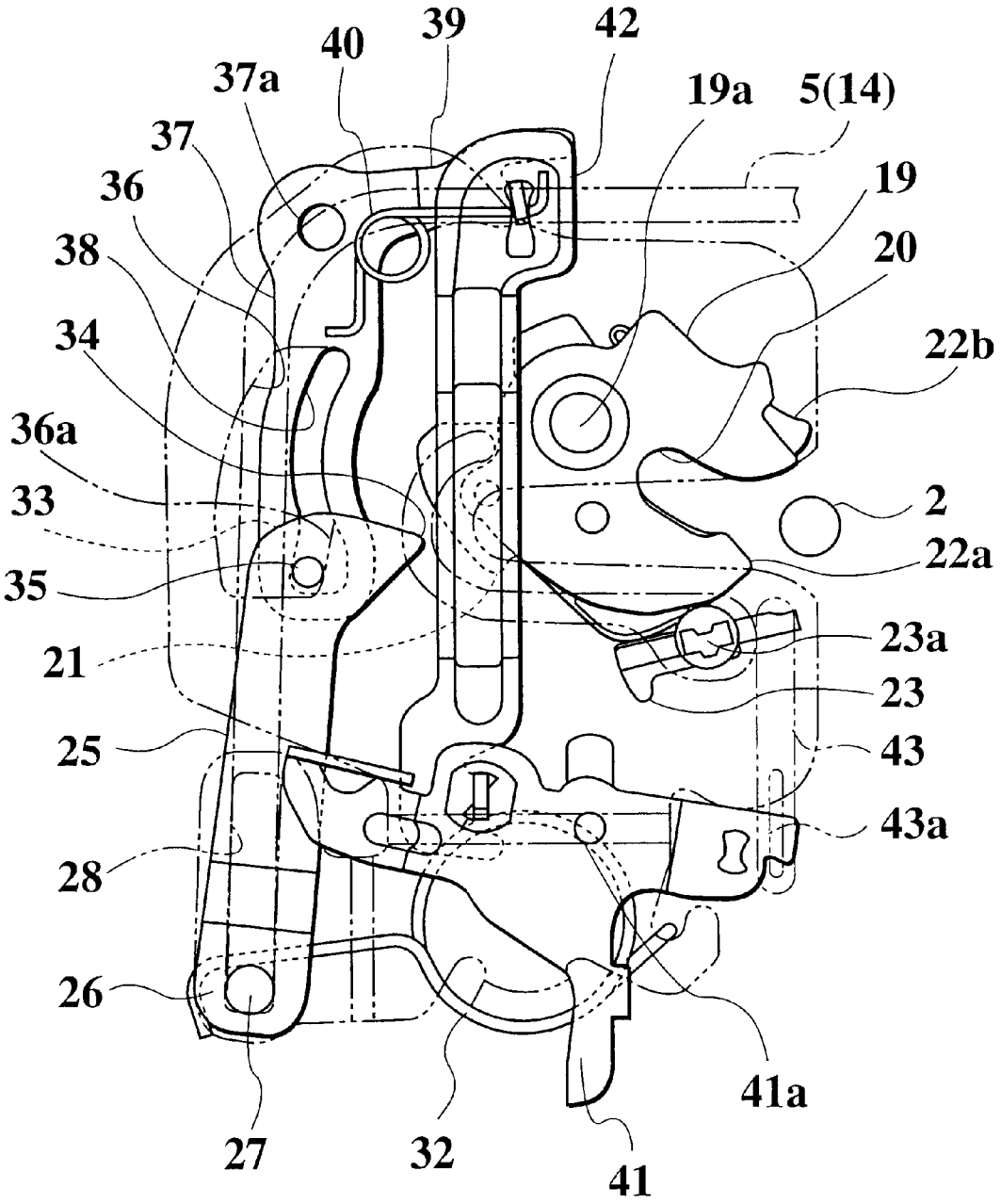
FIG. 14 is a simplified side view that shows the door lock unit, with a latching plate at a released position.

The internal construction of the door lock unit 4 is as follows, this being described chiefly with respect to FIG. 10 and FIG. 14. FIG. 10 shows the internal construction in the condition in which the cover 16 and the components which are mounted to the cover 16 have been removed, and FIG. 14 shows the internal construction including the components that are mounted to the cover 16.

The body 15 of the door lock unit 4 is provided with a latching plate 19 at the upper part of the guide 18 thereof, this latch plate being freely swung about its axis 19*a*.

On this latching plate 19 is formed an engaging groove 20 at the bottom, which accepts the striker 2, and an engaging part 21 at its top. The latching plate 19 has a half-latched engagement point 22*a* and a fully latched engagement point 22*b* on either side of the engaging groove 20. This latching plate 19 can be reciprocally swung about the axis 19*a*, from the released position (FIG. 14), through a half-latched position (FIG. 15) to the fully latched position (FIG. 16).

On the lower side of the latching plate 19 is mounted a pawl 23 which can freely swing about its axis 23*a*. This pawl 23 inhibits the return of the latching plate 19. One end of the pawl 23 engages with the half-latched engagement point 22*a* and the fully latched engagement point 22*b* of the latching plate 19. A half-latched switch S1 (FIG. 13), which detects the half-latched condition of the pawl 23, is provided on the rear side of the pawl 23. This half-latched switch S1 is supported by a bracket 24, which is mounted to the base 13. A fully latched switch S2, which detects the fully latched condition of the latching plate 19, is provided on the upper side of the latching plate 19.

A closing lever 25 is provided on substantially the same plane as the latching plate 19 at a position adjacent to the bottom of the latching plate 19. A pin 27 is provided on the bottom end of this closing lever 25, this pin 27 passing completely through a vertically elongated hole 28 that is provided in a stepped lower end 16*a* of the cover 16, and being joined with a clevis 29 having a U-shaped cross-section. At the top and bottom of the clevis 29 the end of the outer tube 14 is press-fit into a cutout part 30 (FIG. 9) of the base 13. A ball 31 is fixed to the end of the wire 5, which protrudes from the end of the outer tube 14, this ball 31 engaging in the clevis 29. Therefore, the ball 31 at the end of the wire 5 is linked, via the clevis 29, to the bottom end 26 of the closing lever 256, this being the distal end of the path of the wire 5. The bottom end 26 of the closing lever 25 is biased downward by a spring 32 that is provided on the base 13.

A protrusion 34 is provided on the upper end 33 of the closing lever 25. This protrusion 34 faces toward the latching plate 19, so as to engage with the engaging part 21 of the latching plate 19. A pin 35 that protrudes in a direction that is perpendicular to the surface toward the rear of the closing lever 25 is provided on the upper end 33 of the closing lever 25. This pin 35 passes through a guide hole 26, which is formed in the body 15, and is caused to engage with the elongated hole 38 of the pull lever 37 on the rear side.

Figure 15:
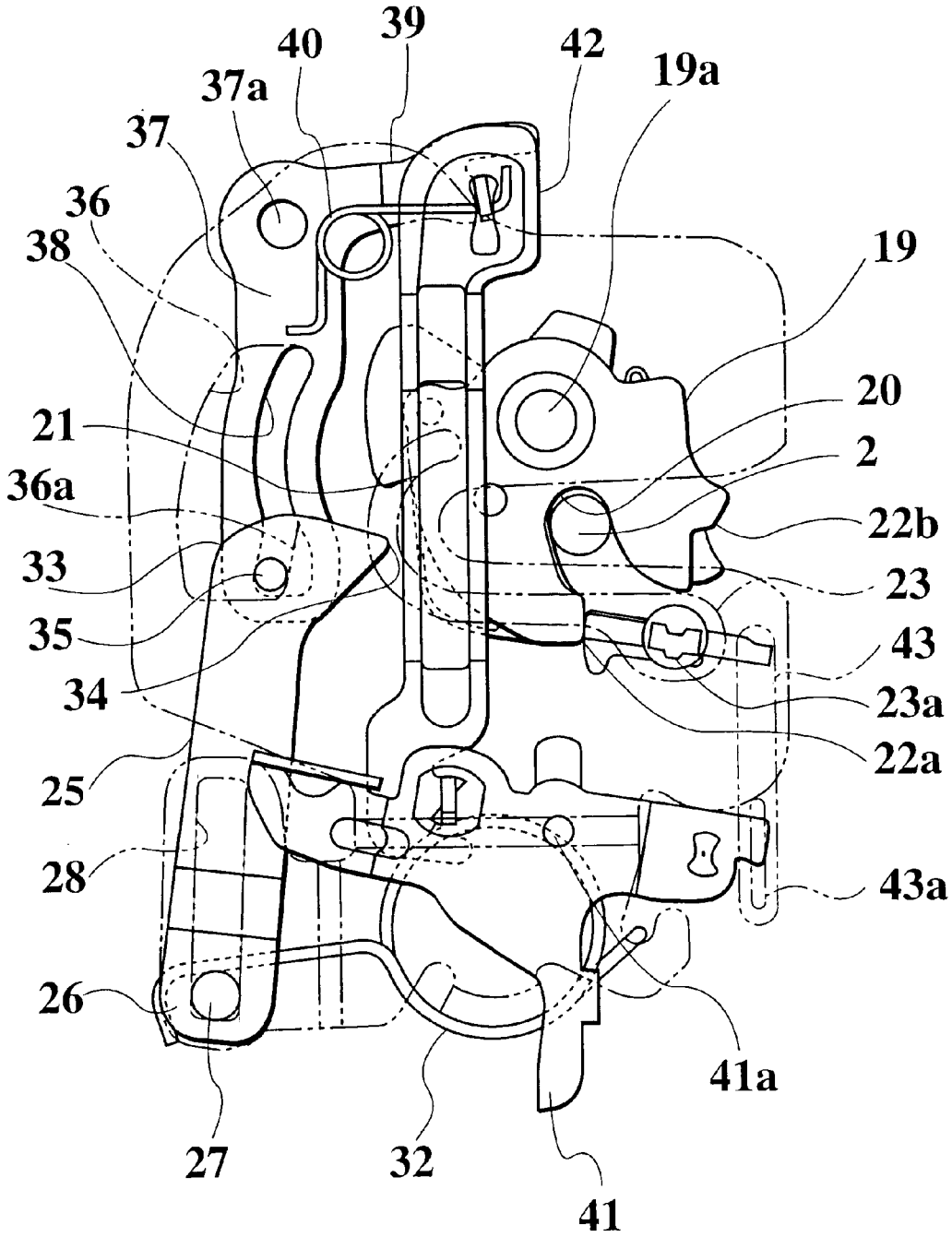
FIG. 15 is a simplified side view that shows the door lock unit with the latching plate in a half-latched position.
Figure 16:
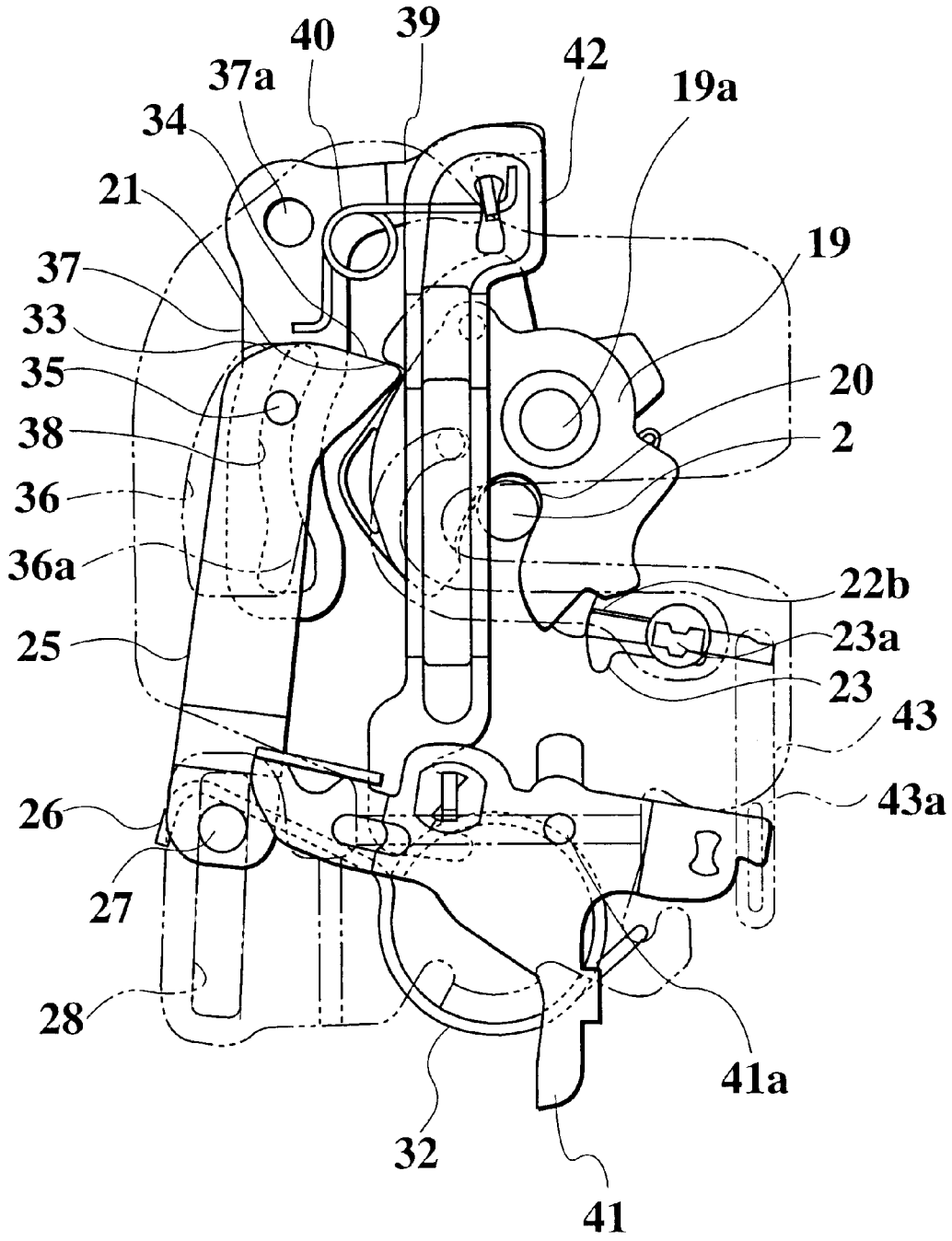
FIG. 16 is a simplified side that shows the door lock unit with the latching plate in a fully latched position.

The guide hole 36 that is formed on the body 15, as shown in FIG. 15, has a width W that allows horizontal movement of the pin 35, and an inclined edge 36*a* is formed on the lower side of the end of the latching plate 19. This inclined edge 36*a* is formed with an inclination toward the latching plate 19 of a prescribed angle θ with respect to the direction in which the wire 5 pulls the closing lever 25.

The elongated hole 38 of the pull lever 37 is arc-shaped, with its center of radius at the axis 19*a* of the latching plate 19. The upper end 39 of the pull lever 37 is bent toward the latching plate 19, and the base of the upper end 39 is swingably mounted to the shaft 37*a*. A spring 40 is provided in the region of the upper end 39 of the pull lever 37, this spring biasing the lower end of the pull lever 37 toward the latching plate 19. This spring 40 and pull lever 37 form the biasing mechanism in this embodiment of the invention.

An outside lever 41 is swingably mounted to the shaft 41*a* on the side of the closing lever 25, the closing lever 25 side end of this outside lever 41 and the upper end of the pull lever 39 being linked by a pull link 42. The end of the outside lever 41 on the opposite side and the non-engaged end of the pawl 23 are linked by mechanism of a link 43. The link 43 and the outside lever 43 are linked With play therebetween, by mechanism of an elongated hole 43*a*.

Figure 5:
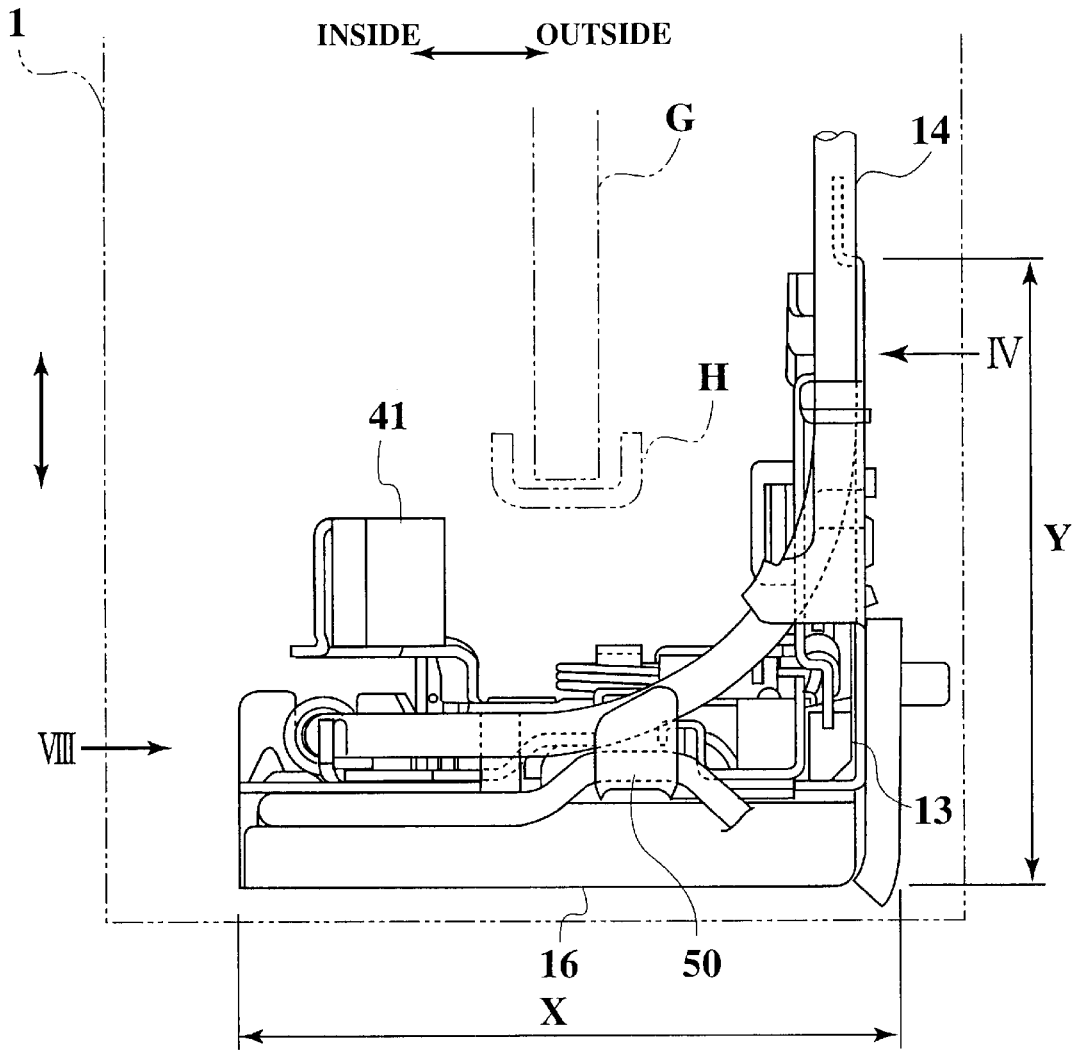
FIG. 5 is a plan view as seen in the direction of arrow V of FIG. 3.
Figure 6:
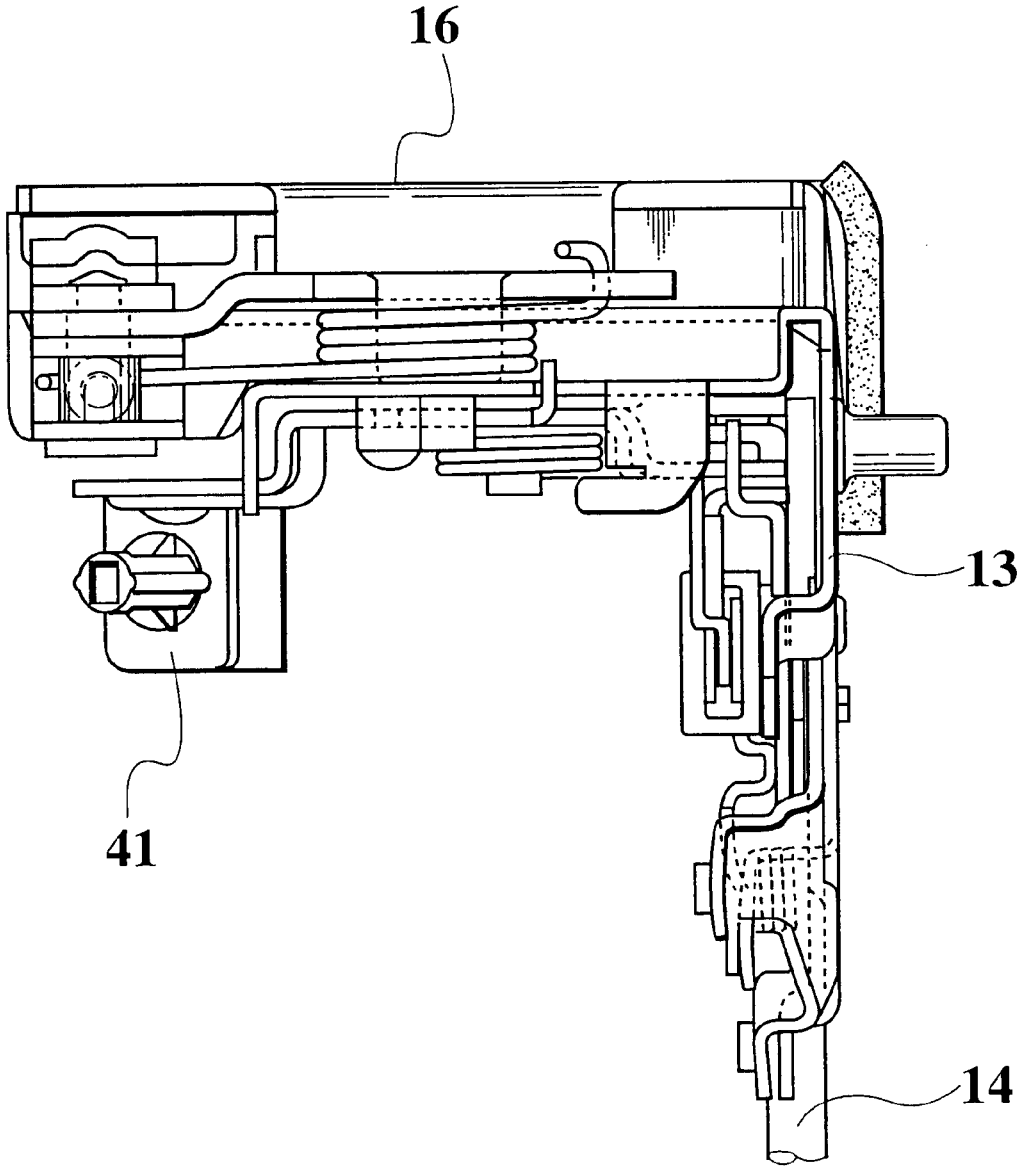
FIG. 6 is a bottom view as seen in the direction of arrow VI of FIG. 3.
Figure 7:
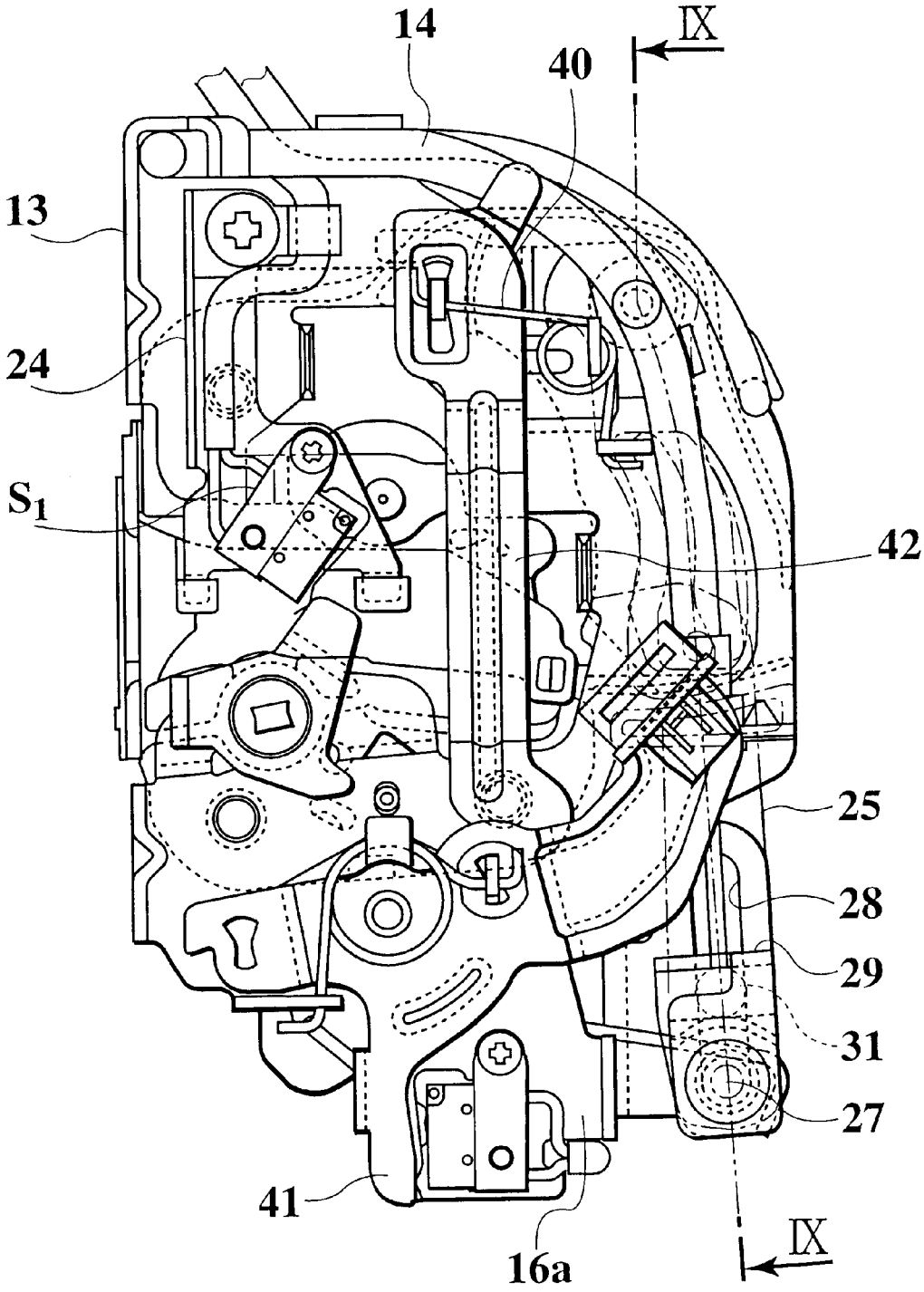
FIG. 7 is a side view as seen in the direction of arrow VII of FIG. 2.
Figure 8:
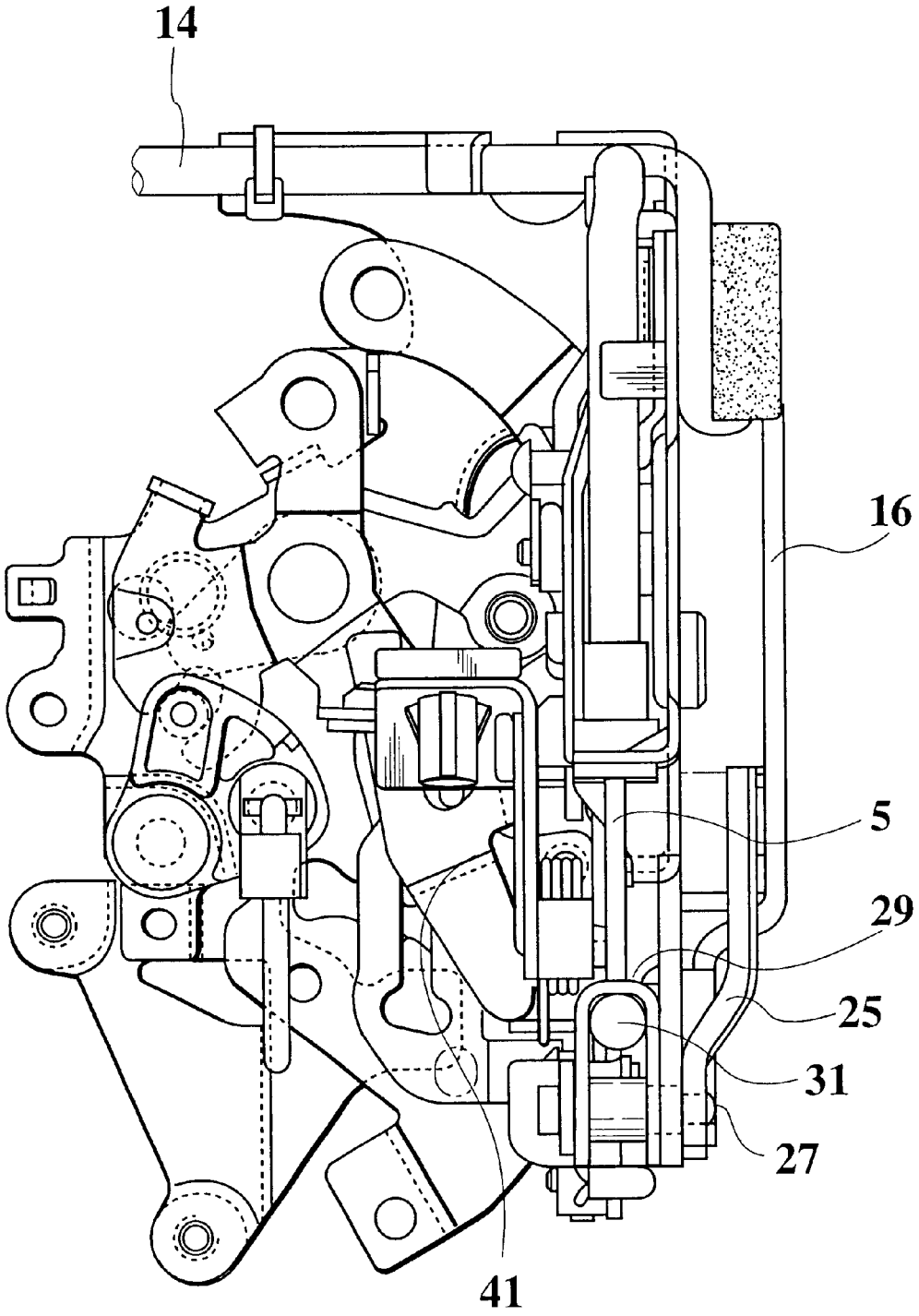
FIG. 8 is a side view as seen in the direction of arrow VIII of FIG. 5.
Figure 9:
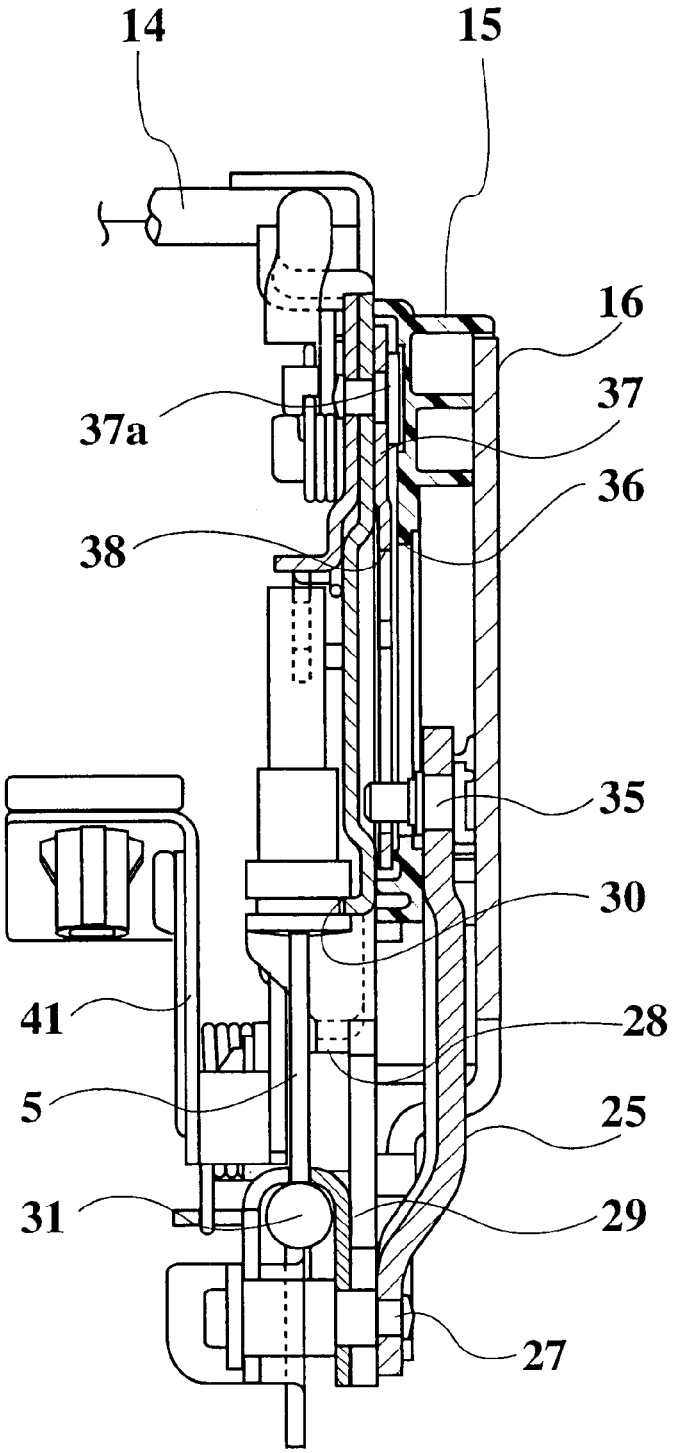
FIG. 9 is a cross-sectional view as seen along line IX—IX of FIG. 7.

According to this embodiment of the invention, because the closing lever 25 and the wire 5 are disposed on substantially the same plane of the outer periphery of the latching plate 19, it is possible to reduce the thickness of the door lock unit 4 (FIG. 5). That is, the thickness of the door lock unit 4 that is provided within the sliding door 1 in the front-to-back direction is reduced. Therefore, there is sufficient room within the door for easy layout of such items as a rollup/rolldown window and a sash H that supports this window within the door 1, without interference from the door lock unit 4. Even with a door lock unit 4 having a reduced thickness X, by forming a step at the lower end 16*a* of the cover 16, the rigidity is improved, and the lower end 26 of the closing lever 25 is joined thereto, the result being that it is possible to accept the driving force from the wire 5 without a loss of mounting rigidity of the closing lever 25.

Additionally, because the closing lever is provided in a vertical direction, and also because the wire 5 is bent downward after passing the top of the latching plate 19, the corresponding parts of the closing lever 25 and the wire 5 are each in the vertical direction, thereby enabling a reduction in the width size Y of the door lock unit 4 (size in the direction perpendicular to the thickness X). It is therefore possible to reduce the thickness of the door itself, thereby enabling an expansion of the space within the vehicle and an improvement in appearance. Because the end of the wire is linked to the lower end of the closing lever, the driving force of the wire makes a U-turn via the closing lever, and then is transmitted to the latching plate, the result being that it is possible to reduce the vertical size Z (FIG. 3) of the door lock unit. Therefore, layout of other components in the vertical space of the door lock unit is facilitated.

The operation of the door lock unit 4 is described below, with reference being made to FIG. 14 through FIG. 18. FIG. 14 shows the condition in which the sliding door 1 is open, with the latching plate 19 in the released position. The closing lever 25 is at the lower side because of the biasing force from the spring 32.

When the sliding door 1 is being closed, when the striker 2 enters into the engaging groove 20 of the latching plate 19, the latching plate 19 swings from the released position to the half-latched position, one end of the pawl 23 engaging with the half-latched engaging point 22*a* of the latching plate 19 (FIG. 15). When the pawl 23 engages with the half-latched engaging point 22*a*, this condition is detected by the half-latched switch S1, a signal being sent to the drive unit 3, so as to drive the motor 7.

When the motor 7 is driven, because the wire 5 is pulled, the pulling of the wire 5 pulls the closing lever 25 upward. Although the direction of pulling of the wire is upward, because the wire 5 joining point is at the lower end 26 of the closing lever 25 (the upper end 33 being capable of horizontal movement) and because the spring 40 and the pull lever 37 elongated hole 38 bias the pin 35 toward the inclined edge 36*a*, the pin 35 moves toward the latching plate 19 at an angle θ, along the inclined edge 36*a*, the result being that the protrusion 34 of the closing lever 25 engages with the engaging 5 part 21 of the latching plate 19 by an inclined shortcut path.

The protrusion 34 of the closing lever 25 engages with the engaging part 21 at the point at which the pin 35 reaches the top end of the inclined edge 36*a*, after which it pushes the latching plate 19, along the arc-shaped elongated hole 38. Because the path of the protrusion 34 of the closing lever 25 is an arc, along the elongated hole 38 of the pull lever 37, after engagement with the engaging part 21, it is possible to reliably swing the latching plate 19 to the fully latched position (FIG. 16). When the latching plate reaches the fully latched position, one end of the pawl 23 engages with the fully latched engagement point 22*b* of the latching plate 19, thereby preventing its return.

Figure 17:
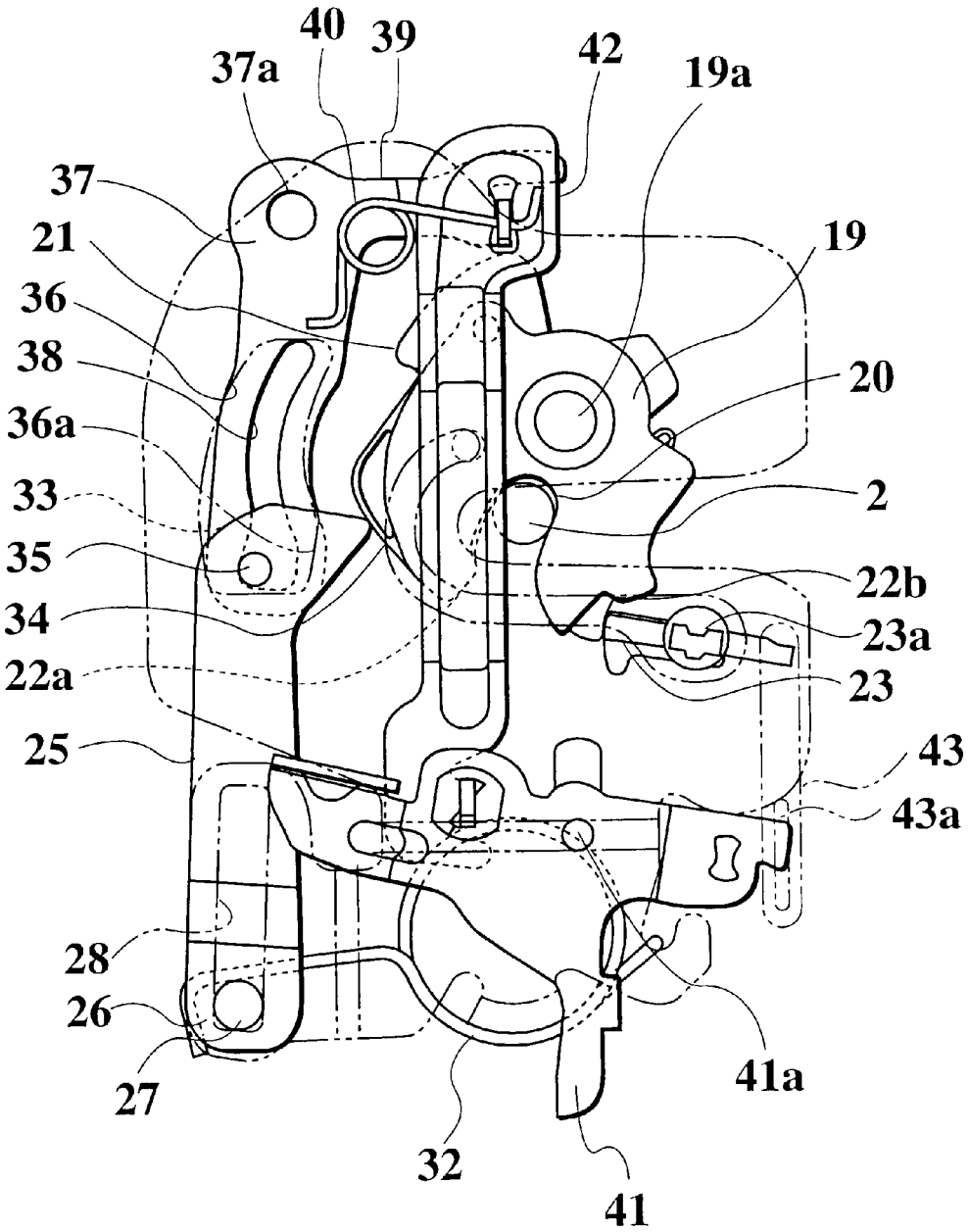
FIG. 17 is a simplified side view that shows the door lock unit with the latching plate in the fully latched position and a closing lever dropped.

When the latching plate 19 reaches the fully latched position, this condition is detected by the fully latched switch S2, the motor 7 being driven in reverse, so as to push the closing lever 25 using the wire 5, thereby lowering the closing lever 25 (FIG. 17). Even if the latching plate 19 returns to the half-latched position, the lowering of the closing lever 25 is continued up until a position at which the engaging part 21 thereof does not engage with the protrusion 34 of the closing lever 25, this being a position outside the path of the engaging part 21 up to the fully latched position. By doing this, even if the latching plate 19 should for some reason be swung to the half-latched position, it is possible to reach the half-latched position without having the engaging part 21 engage at an intermediate position with the protrusion 34 of the closing lever 25. Thus, by detection by the half-latched switch S1, it is possible to swing the latching plate 19 once again to the fully latched position. By mechanism of the above-noted operation, the latching plate 19 is placed reliably in the closed condition, in which it is engaged with the striker 2 on the vehicle side.

Figure 18:
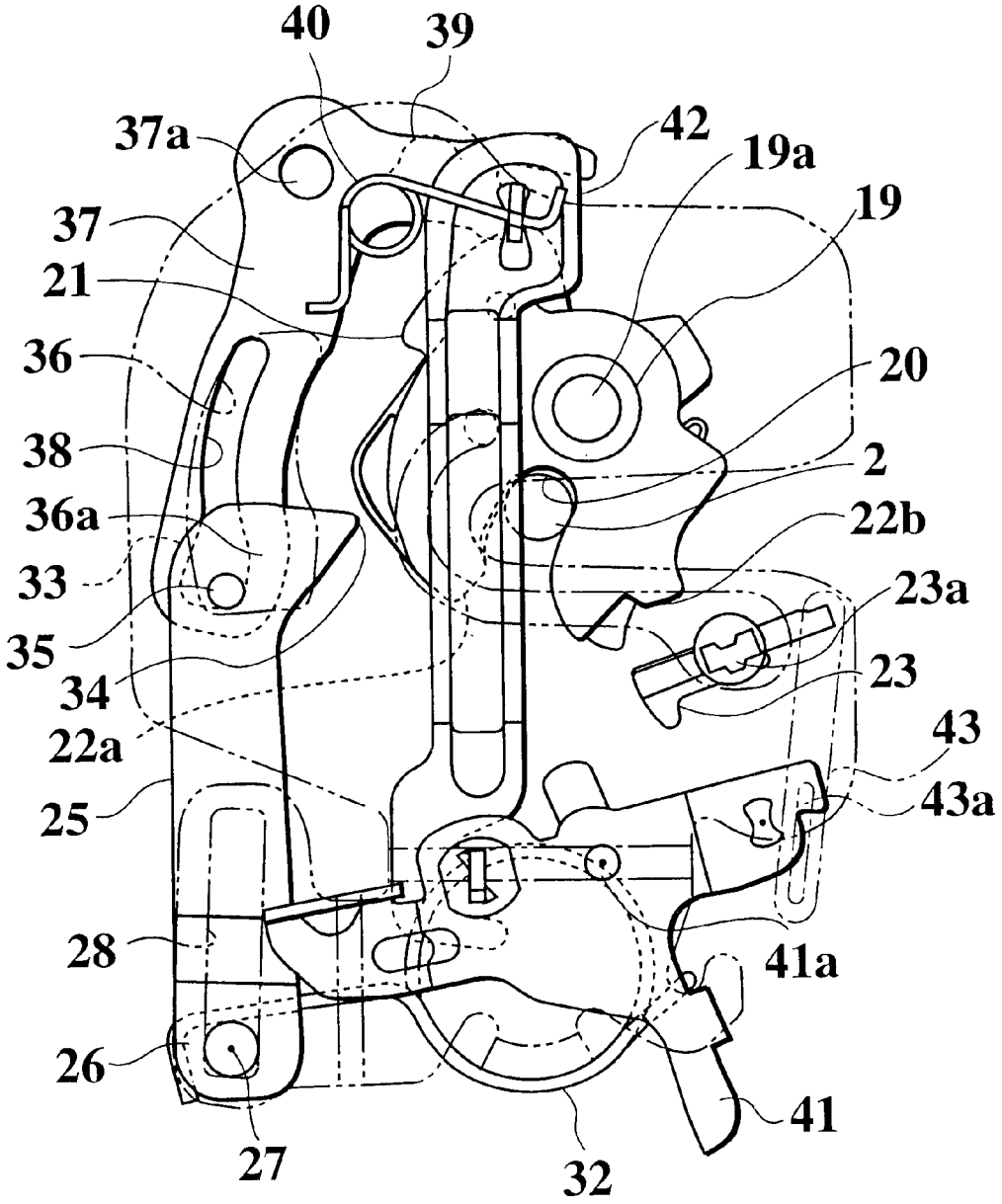
FIG. 18 is a simplified side view of the door lock unit, showing a condition in which the latching plate is on a way of return to the released position.

To open the sliding door 1 from the closed condition, an outside handle or the like (not shown in the drawing) is operated, so as to swing the outside lever 41 in the counterclockwise direction. When this is done, the upper end 39 of the pull lever 37 is pulled and lowered by the pull link 42, the result being that the lower end of the pull lever 37 is swung along with the pin 35 of the closing lever 25 in the direction away from the latching plate 19. Thus, the protrusion 34 of the closing lever 25 is greatly 5 distanced from the latching plate 19 (FIG. 18).

Simultaneously with the above, the action of the link 43 causes one end of the pawl 23 to become removed from the fully latched engaging point 22*b* of the latching plate 19. The latching plate 19 therefore swings to released position via the half-latched position, placing the sliding door 1 in the opened condition. Because the protrusion 34 of the closing lever 25, as described above, is greatly distanced from the latching plate 19, even if the latching plate 19 exceeds the half-latched position in this manner, there is no interference between the protrusion 34 of the closing lever 25 and the latching plate 19.

As described in detail above, according to this embodiment of the invention, because the protrusion 34 of the closing lever 25 engages the engaging part 21 of the latching place 19 at a short distance at an angle of θ that is different from the direction of pulling the wire 5, it is possible to shorten the amount of stroke of the wire 5. Therefore, the amount of play from the point at which the motor 7 of the drive unit 3 starts to rotate until the point at which the latching plate actually starts to swing is reduced, thereby reducing the amount of time required to achieve the fully latched condition from the half-latched condition. It is additionally possible to reduce the size of the drive unit 3 that drives the wire 5, thereby enabling a reduction in the weight of the vehicle body, and to make more effective use of the space within the sliding door 1.

While the above description was for the example of a sliding door 1 in which the door closure system is installed, the invention is not restricted in this manner, and can be applied to other types of doors, such as a rear hatchback door of a vehicle.

While preferred embodiments of the present invention have been described using specific terms, such description is for illustrative purposes, and it is to be understood that changes and variations may be made without departing from the spirit or scope of the following claims.

What is claimed is:

1. A door lock unit of a vehicular door closure system comprising:

a latching plate, which is free to reciprocally swing about an axis from a released position, through a half-latched position, to a fully latched position;

a closing lever, which is provided so as to extend in the up/down direction, and which, when it rises to an engaging part formed on an edge of the latching plate, engages therewith and causes the latching plate to swing toward the fully latched position;

a wire, which is linked to the lower end of the closing lever, and which transmits driving force for the purpose of raising the closing lever, wherein the closing lever and the outer peripheral part of the latching plate are disposed on substantially the same plane, the wire passing the upper part of the latching plate, after which it is bent downward and linked to the lower end of the closing lever;

a cover which covers the latching plate and the closing lever, and which has a lower edge that is stepped towards the closing lever, the lower end of the closing lever being mounted to the lower end of the cover so as to be freely movable upward and downward;

the closing lever at the lower end being engaged by a pin movable within an elongate hole formed in the cover; and the wire being directly connected by the pin to the closing lever.

2. A door lock unit of a vehicular door closure system comprising:

a latching plate, which is free to reciprocally swing about an axis from a released position, through a half-latched position, to a fully latched position;

a closing lever, which is provided so as to extend in the up/down direction, and which, when it rises to an engaging part formed on an edge of the latching plate, engages therewith and causes the latching plate to swing toward the fully latched position;

a wire, which is linked to the lower end of the closing lever, and which transmits driving force for the purpose of raising the closing lever, wherein the closing lever and the outer peripheral part of the latching plate are disposed on substantially the same plane, the wire passing the upper part of the latching plate, after which it is bent downward and linked to the lower end of the closing lever;

a cover which covers the latching plate and the closing lever, and which has a lower edge that is stepped towards the closing lever, the lower end of the closing lever being mounted to the lower end of the cover so as to be freely movable upward and downward;

an engaging groove that accepts a striker and an engaging part that inputs rotational force formed on the latching plate;

a protrusion, which engages the latching plate engaging part is disposed as the half-latched position, and a pin, which is in the direction perpendicular to the surface of the latching plate, are formed on the upper end of the closing lever;

a guide hole formed on the body onto which the latching plate and closing lever are mounted, into which a pin on the other end of the closing lever is positioned;

an inclined edge formed on the latching plate end of the guide hole, at a prescribed angle with respect to a direction that the wire pulls the closing lever;

a biasing mechanism provided on the body, which biases the pin on the other end of the closing lever toward the inclined edge, and further wherein when the closing lever is pulled by the wire, the pin of the closing lever moves toward the latching plate at a prescribed angle, along the inclined edge of the guide hole, the protrusion of the closing lever engaging with the engaging part of the latching plate and causing the latching plate to swing toward the fully latched position, and when the closing lever is pushed by the wire, the protrusion of the closing lever returns to outside the limit of swinging of the engaging part from the fully latched position to the half-latched position.

3. A door lock unit of a vehicular door closure system comprising:

a latching plate, which is free to reciprocally swing about an axis from a released position, through a half-latched position, to a fully latched position;

a closing lever, which is provided so as to extend in the up/down direction, and which, when it rises to an engaging part formed on an edge of the latching plate, engages therewith and causes the latching plate to swing toward the fully latched position;

a wire, which is linked to the lower end of the closing lever, and which transmits driving force for the purpose of raising the closing lever, wherein the closing lever and the outer peripheral part of the latching plate are disposed on substantially the same plane, the wire passing the upper part of the latching plate, after which it is bent downward and linked to the lower end of the closing lever;

an engaging groove that accepts a striker and an engaging part that inputs rotational force are formed on the latching plate, a protrusion, which engages the latching plate engaging part that is disposed as the half-latched position, and a pin, which is in the direction perpendicular to the surface of the latching plate are formed on the upper end of the closing lever, a guide hole is formed on the body onto which the latching plate and closing lever are mounted, into which a pin on the other end of the closing lever is positioned, an inclined edge is formed on the latching plate end of the guide hole, at a prescribed angle with respect to a direction that the wire pulls the closing lever, a biasing mechanism is provided on the body, which biases the pin on the other end of the closing lever toward the inclined edge, and further wherein when the closing lever is pulled by the wire, the pin of the closing lever moves toward the latching plate at a prescribed angle, along the inclined edge of the guide hole, the protrusion of the closing lever engaging with the engaging part of the latching plate and causing the latching plate to swing toward the fully latched position, and when the closing lever is pushed by the wire, the protrusion of the closing lever returns to outside the limit of swinging of the engaging part from the fully latched position to the half-latched position; and a pull lever, which has an elongated arc-shaped hole having as its center of curvature the axis of the latching plate and disposed substantially on the same plane as the outer periphery of the latching plate, is provided on the upper part of the closing lever, the pin on the upper end of the closing lever being made to engage the elongated hole, and a spring is provided on the upper end of the pull lever so as to bias the elongated hole part in an approaching direction to the latching plate.

4. A door lock unit of a vehicular door closure system according to claim 3, wherein the width of the guide hole that is formed on the body is a size that allows the pin of the closing lever to move horizontally, the upper end of the pull lever is bent toward the latching plate, and further comprising an outside lever that is mounted to the bottom of the pull lever so as to be able to swing about an axis, and a pull link that is provided so as to join the end of the outside lever that rises when an opening operation is done with the upper end of the pull lever, wherein the outside lever and pull lever are disposed substantially on the same plane as the periphery of the latching plate.

5. A door lock unit of a vehicular door closure system comprising:

a latching plate, which is free to reciprocally swing about an axis from a released position, through a half-latched position, to a fully latched position, this latching plate comprising an engaging groove, which accepts a striker that is provided on the vehicle side, and an engaging part at which rotational force is input; and a closing lever provided at a position adjacent to the latching plate, the distal end of the closing lever in the wire path being linked to a wire and causing the wire to move, and the other end of the closing lever having formed therein a protrusion which engages with the engaging part of the latching plate in the half-latched position and causes a swinging of the latching plate to the fully latched position; and a pin, which protrudes in a direction that is perpendicular with respect to the latching plate surface, wherein on a body to which the latching plate and closing lever are mounted a guide hole is formed, into which is positioned the pin at the other end of the closing lever, and an inclined edge which is inclined towards the latching plate by a prescribed angle with respect to the direction in which the wire pulls the closing lever is formed at the guide hole, a biasing mechanism being further provided on the body, which biases the pin on the other end of the closing lever toward the inclined edge, and further wherein when the closing lever is pulled by the wire, the pin of the closing lever moves toward the latching plate at a prescribed angle, along the inclined edge of the guide hole, the protrusion of the closing lever engaging with the engaging part of the latching plate and causing the latching plate to swing toward the fully latched position, and when the closing lever is pushed by the wire, the protrusion of the closing lever returns to outside the limit of swinging of the engaging part from the fully latched position to the half-latched position.

6. A door lock unit of a vehicular door closure system according to claim 5, further comprising:

a pull lever having an elongated arc-shaped hole having as its center of curvature the axis of the latching plate, which is provided on the upper part of the closing lever; and a spring that is provided on the upper end of the pull lever so as to bias the elongated hole part in an approaching direction to the latching plate, so as to cause the pin on the upper end of the closing lever to engage the elongated hole.

7. A door lock unit of a vehicular door closure system according to claim 6, wherein the width of the guide hole that is formed on the body is a size that allows the pin of the closing lever to move horizontally, and the upper end of the pull lever is bent toward the latching plate, the door lock unit further comprising an outside lever, which is mounted to the bottom of the pull lever so as to be able to swing about the axis, and a pull link, which is provided so as to join the end of the outside lever that rises when an opening operation is done with the upper end of the pull lever.

8. A door lock unit of a vehicular door closure system according to claim 7 further comprising a pawl, which is provided at a position adjacent to the latching plate, this pawl inhibiting the return swing of the latching plate by having one end thereof engage with the latching plate at the half-latched position and at the fully latched position, the other end of the pawl being linked by a link to the end of the outside lever that is lowered by the opening operation of the outside lever.

9. A door lock unit of a vehicular door closure system comprising:

a latch plate that swings about a first axis and engages with a striker;

a closing lever, which swings about a second axis, which is lower than the first axis, and which engages with the latching plate;

and a mechanism that controls the distance between the first and the second axes, wherein the distance controlling mechanism includes an operating wire, this operating wire being directly connected to the second axis and moving the second axis up and down.

10. A door lock unit of a vehicular door closure system according to claim 9, wherein the closing lever can swing about a third axis, which is higher than the second axis, and the third axis can move horizontally with respect to the first axis.

* * * * *